US006619478B2

(12) United States Patent
Fukugawa et al.

(10) Patent No.: US 6,619,478 B2
(45) Date of Patent: Sep. 16, 2003

(54) LIGHT-SHIELDING PACKAGING SYSTEM FOR PHOTOSENSITIVE WEB ROLL

(75) Inventors: Masafumi Fukugawa, Kanagawa (JP); Akihisa Inoue, Kanagawa (JP); Norihiro Kadota, Kanagawa (JP); Koichi Nakatogawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/745,868

(22) Filed: Dec. 26, 2000

(65) Prior Publication Data

US 2002/0117415 A1 Aug. 29, 2002

(30) Foreign Application Priority Data

Dec. 27, 1999 (JP) ..... 11-371318
Dec. 27, 1999 (JP) ..... 11-371319

(51) Int. Cl.[7] ..... B65D 85/66
(52) U.S. Cl. ..... 206/410; 206/413
(58) Field of Search ..... 206/389, 399, 206/400, 401, 402, 410, 411, 412, 413, 414, 415, 416, 455

(56) References Cited

U.S. PATENT DOCUMENTS 3,942,638 A * 3/1976 Stone ..... 206/410
4,148,395 A * 4/1979 Syracuse et al. ..... 206/414
4,733,777 A * 3/1988 Van Geyte et al. ..... 206/400
4,911,299 A * 3/1990 Peeters ..... 206/410
5,222,601 A * 6/1993 Takahashi et al. ..... 206/414
5,353,933 A * 10/1994 Takahashi et al. ..... 206/398
5,363,962 A * 11/1994 Toral et al. ..... 206/303
5,452,797 A * 9/1995 Pollard ..... 206/413
5,472,089 A * 12/1995 Specogna et al. ..... 206/410
5,738,210 A * 4/1998 Kausch et al. ..... 206/397
6,048,676 A * 4/2000 De Leener et al. ..... 206/316.1
6,060,137 A * 5/2000 Akao ..... 428/35.2
6,179,123 B1 * 1/2001 Shigeta et al. ..... 206/410
6,375,008 B2 * 4/2002 Shigeta et al. ..... 206/397

* cited by examiner

*Primary Examiner*—Shian Luong
(74) *Attorney, Agent, or Firm*—Sughrue Mion, PLLC

(57) ABSTRACT

A light-shielding packaging for a roll of continuous photosensitive web wound on a core having on its each end a light-shielding flange disc has at its leading end a light-shielding leader sheet. The leader sheet is composed of a longitudinal light-shielding base sheet and two heat-shrinkable light-shielding strips, in which each of the light-shielding strips is tearable predominantly in its longitudinal direction and is fixed onto a surface of each side of the light-shielding base sheet under the condition that the light-shielding strip is aligned in parallel with the side of the longitudinal base sheet to project its portion from the side of the base sheet.

13 Claims, 4 Drawing Sheets

(STEP 1)

(STEP 2)

(STEP 3)

(STEP 4)

LIGHT-SHIELDING PACKAGING SYSTEM FOR PHOTOSENSITIVE WEB ROLL

FIELD OF THE INVENTION

The present invention relates to a continuous photosensitive web having a leader portion and further relates to a light-shielding packaging for a roll of the photosensitive web.

BACKGROUND OF THE INVENTION

A light-shielding packaging for a roll of continuous photosensitive web wound on a core having on its each end a light-shielding flange disc is known and actually utilized, particularly, for the purpose of roomlight loading of a roll of continuous photosensitive web into a camera or other image-forming apparatus in which the photosensitive web is to be exposed.

European Patent Application No. 0 181 417 A1 (issued on May 21, 1986) discloses a packaging of rolls of light-sensitive material such as strip of photographic film or paper, for roomlight loading. The packaging comprises opaque material which protects the rolled material from light while leaving a leader of the rolled material exposed and which an be torn by pulling on such leader to cause the light-sensitive material to commence unwinding from the roll. A piece of heat-shrinkable sheet material is used together to cover the leader as well as a portion of the light-sensitive material.

U.S. Pat. No. 4,733,777 (issued on Mar. 29, 1988) and European Patent Specification 0 230 057 B1 (issued on May 16, 1990) both disclose a light-tightly packaged roll of light-sensitive material, which comprises an annular end cover for each end face of the roll and a circumferential cover wound around the periphery of the roll and having lateral extensions sealed with their inner surface to the inner surface of radially outwardly projecting margins of the end covers.

U.S. Pat. No. 4,911,299 (issued on Mar. 27, 1990) discloses a strip of light sensitive material wound in a coil onto an open-ended core which is packaged in tearable light tight wrapping material protecting the rolled web while leaving an exterior end of the coil exteriorly accessible. The light tight wrapping material is tearable by pulling on the exterior end to commence unwinding of the coil from the core.

European Patent Application 0 681 212 A1 (issued on Nov. 8, 1995) and U.S. Pat. No. 5,472,089 (issued on Dec. 5, 1995) both disclose a light-tight packaging for photosensitive web roll having a flexible leader portion that overlaps the outermost first convolution of the roll. The leader has three stretchable segments in which can cooperate with light-shielding flange portions to form light-tight labyrinth-type sealing.

Thus, for the purpose of satisfactory light-tight sealing, known packagings for photosensitive web utilize overall light-shielding sealing which is tearable or releasable from the flange when the leader is pulled to commence unwinding of the photosensitive web, or structural sealing such as labyrinth-type sealing.

SUMMARY OF THE INVENTION

The present invention has an object to provide a new light-shielding packaging system for a roll of continuous photosensitive web wound on a core having an its both ends a light-shielding flange disc.

The invention further has an object to provide a continuous photosensitive web having a light-shielding leader sheet, which is favorably employable for the new light-shielding packaging system.

The invention furthermore has an object to provide a continuous photosensitive web having a light-shielding leader which shows a high dimensional stability at surrounding temperatures which the photosensitive web sometimes encounters.

The present invention resides in a continuous photosensitive web having at least at one end thereof a light-shielding leader sheet which comprises a longitudinal light-shielding base sheet and a pair of heat-shrinkable light-shielding strips, in which each of the heat-shrinkable light-shielding strips is tearable predominantly in a longitudinal direction thereof and is fixed onto a surface of each side of the light-shielding base sheet under the condition that the light-shielding strip is aligned in parallel with the side of the longitudinal base sheet to project a portion thereof from the side of the base sheet.

The invention further resides in a light-shielding packaging for a roll of continuous photosensitive web wound on a core having on each end thereof a light-shielding flange disc, which has at a leading end thereof a light-shielding leader sheet which comprises a longitudinal light-shielding base sheet and a pair of heat-shrinkable light-shielding strips, in which each of the light-shielding strips is tearable predominantly in a longitudinal direction thereof and is fixed onto a surface of each side of the light-shielding base sheet under the condition that the light-shielding strip is aligned in parallel with the side of the longitudinal base sheet to project a portion thereof from the side of the base sheet, said leader sheet having a length larger than the length of the outermost convolution of the roll and a width larger an the distance between the outer face of one flange disc and the outer face of another flange disc, and each strip attached to the leader sheet being light-tightly fixed via heat shrinkage and fusion thereof onto the outer face of the flange disc at least at a portion adjacent to the periphery of the flange disc.

DETAILED DESCRIPTION OF THE INVENTION

The continuous photosensitive web and light-shielding packaging according to the invention are described below in more detail by referring to the attached drawings.

Figure 1:
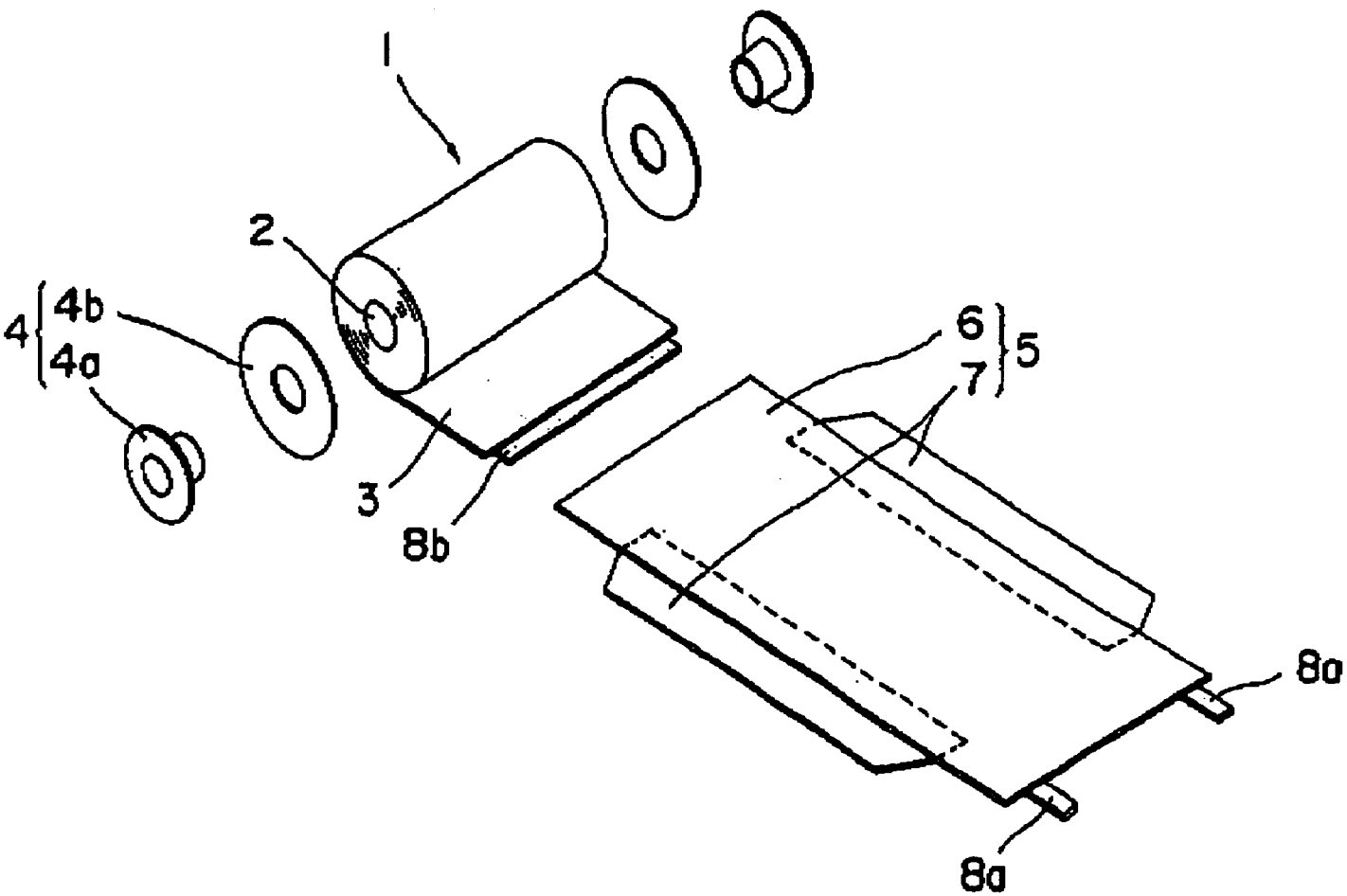
FIG. 1 illustrates a roll of a continuous photosensitive web having a light-shielding leader sheet at its leading end according to the invention, which is wound on a core having on its both ends a light-shielding flange disc.

FIG. 1 illustrates a roll 1 of a continuous photosensitive web 3 having a heat-shrinkable light-shielding leader sheet 5 at its leading end according to the invention, which is wound on a core 2 having on its both ends a light-shielding flange disc 4. The leading end of the leader sheet 5 has adhesive tapes 8*a* for temporarily fixing the leading end onto the preceding convolution of the leader sheet 5 The photosensitive web 3 and the leader sheet 5 is combined together using adhesive tape 8*b*. The flange 4 is composed of a cap 4*a* and a ring element 4*b*.

The characteristic feature of the invention resides in the composition of the leader sheet which is composed of a longitudinal light-shielding base sheet and a pair of heat-shrinkable light-shielding strips. Each of the heat-shrinkable light-shielding strips is tearable predominantly in its longitudinal direction and is fixed onto a surface of each side of the light-shielding base sheet under such condition that the light-shielding strip is aligned in parallel with the side of the longitudinal base sheet to project in portion from the side of the base sheet.

The leader sheet 5 (or longitudinal base sheet 6) has a length larger than, preferably twice or less, the length of the outermost convolution of the roll 1, and a width of the base sheet 6 is larger than the distance between the outer face of one flange disc 4 and the outer face of another flange disc. Each side portion of the leader sheet is attached a heat-shrinkable light-shielding strip 7 which is to be light-tightly fixed via its heat shrinkage and fusion onto the outer face of the flange disc 4 (ring element 4*b*) at least at a portion adjacent to the periphery of the flange disc 4.

The light-shielding base sheet 6 preferably has essentially no heat-shrinkable property, and can be one of known light-shielding leader sheets for continuous photosensitive webs. An example of the base sheet comprises a low density polyethylene film containing a colored pigment such as carbon black.

The heat-shrinkable light-shielding strip 7 preferably has a length larger than, preferably twice or less, the length of the outermost convolution of the roll 1. The light-shielding strip 7 is preferably attached to the surface of the base sheet 6 on the side not facing the photosensitive web.

The heat-shrinkable light-shield strip preferably has an Elmendorf tear strength (or force) in the range of 0.1N to 0.5N in the longitudinal direction and has a heat shrinkage ratio at 100° C. in the range of 5% to 30% in the longitudinal direction and a heat shrinkage ratio at 100° C. of less than the heat shrinkage ratio in the longitudinal direction by 1% (preferably 5%) or more in its width direction. Elmendorf tear strength is determined according to JIS K 7128–2:1998 (Tear Strength Measurement Test for Plastic Film or Sheet, Second Part).

The heat-shrinkable light-shielding strip preferably comprises a heat-shrinkable film placed between a pair of light-shielding thermoplastic films. The light-shielding thermoplastic films preferably are essentially no heat-shrinkable.

The heat-shrinkable light-shielding strip is tearable preferably along the side of the base sheet or along an outwardly extending curve starting from a point at which a leading end of the strip is in contact with the side of the base sheet.

The heat shrinkage ratio can be determined in silicone oil heated to 100° C. under the conditions defined in JIS Z 1709–1976.

The heat-shrinkable light-shielding strip of the invention shows a heat shrinkage ratio at 50° C. of lower than 1%, preferably lower than 0.5%, both in the longitudinal and width directions and a heat shrinkage ratio at 100° C. in the range of 5% to 30%, preferably 10 to 30%, more preferably 15 to 30%, in the longitudinal direction and a heat shrinkage ratio at 100° C. of less than the heat shrinkage ratio in the longitudinal direction by 1% or more, in the width direction.

The heat-shrinkable light-shielding strip of the invention comprises a resin material and a colorant, and may be a single layer strip or a double or triple layer strip. Preferred structures of the heat-shrinkable light-shielding strips are a structure comprising a heat-shrinkable film which is placed between a pair-of light-shielding films, and a structure comprising a light-shielding film which is placed between a pair of heat-shrinkable films. A film comprising four or more layers may be employed. At least one layer of the strip is heat-shrinkable, and at least one layer contains a colorant, preferably carbon black, in an amount, for instance, 1 to 5 weight %, preferably 2 to 4 weight %, enough for imparting to the strip the light-shielding property. The carbon black-containing layer may be produced by coating a heat-shrinkable plastic film with a carbon black-containing paint, or placing an independently prepared carbon black-containing film on a heat-shrinkable plastic film via an adhesive. The colorant-containing layer preferably is an essentially no heat-shrinkable.

The resin material of the strip may be polyethylene, polypropylene, polyvinyl chloride, polystyrene, styrene-butadiene copolymer, polyvinylidene chloride, polyester, or one of mixtures of these resin materials with an amorphous polyolefin. The amorphous polyolefin may be incorporated into the resin material in an amount of 5 to 90 weight %, preferably 60 to 90 weight %, more preferably 70 to 80 weight %. The incorporation of the amorphous olefin into the resin material for the preparation of the leader sheet is effective to impart to the strip a high heat shrinkage ratio. The amorphous polyolefin preferably is a cyclic olefin-copolymer, and preferably shows a glass transition temperature (Tg) in the range of 60 to 120° C., more preferably 60 to 100° C.

The resin material of the heat shrinkable strip is preferably made using a mixture of a polyethylene resin and the amorphous polyolefin. Preferred examples of the polyethylene resins include a low density polyethylene (LDPE), a linear low density polyethylene (LLDPE), and a high density polyethylene (HDPE). These polyethylene resins can be employed in combinations, The heat-shrinkable light-shielding strip of the invention is favorably produced by melt extrusion, particularly by the known inflation method. When the strip of the invention is produced by the inflation method, a blow-up ratio (or a blow ratio) preferably is in the range of 0.5 to 1.5.

As described above, the heat-shrinkable light-shielding strip of the invention can comprises a heat-shrinkable film and a light-shielding film. The heat-shrinkable film generally has a thickness of 10 to 100 $\mu$m, preferably 12 to 60 $\mu$m, more preferably 30 to 50 $\mu$m, and the light-shielding film (having a similar, less or no heat-shrinkable property) generally has a thickness of 20 to 100 $\mu$m, preferably 20 to 50 $\mu$m, more preferably 23 to 40 $\mu$m. The light-shielding film can comprise a resin material and a colorant such as carbon black. Examples of the resin materials are the same as described above for the resin material of the leader sheet.

The heat-shrinkable film, which is generally transparent, preferably has a heat shrinkage ratio at 50° C. of less than 2% both in the longitudinal and width directions, while a heat shrinkage ratio at 100° C. in the range of 15% to 30% in the longitudinal direction and a heat shrinkage ratio at 100° C. of less than 50% in the width direction. Various heat-shrinkable film showing such heat-shrinkage characteristics are commercially available, for instance, Landy Five, Grades HS, VP-B, RC, SE, and VP-3B (available from Ookura Industries, Co., Ltd.) and Fancy Wrap, Grades THS, TNS, TAS, TBS, and TRS (available from Gunze Co., Ltd.).

In any cases, a plastic film of the strip to be attached to the outer surface of the flange preferably is thermoplastic so as to fuse on the flange, whereby the strip is well fixed onto the flange surface.

The heat-shrinkable light-shielding strip (and also the light-shielding base sheet) can be prepared by cutting a continuous stretched or unstretched sheet or film in its width (traverse) direction.

The heat-shrinkable light-shielding strip of the invention preferably has a tensile strength in the range of 1 to 3 $kg/mm^2$ in the direction along the longitudinal direction of the photosensitive web (or the strip), and that in the range of 1.5 to 3.5 $kg/mm^2$ in the width direction. The tensile strength is measured according to the procedure described in JIS K 7127. The strip of the invention preferably has a tensile elongation of 300 to 600% in both directions. The tensile elongation is also measured according to the procedure described in JIS K 7127. The strip of the invention preferably has an initial modulus of 5,000 to 8,000 $kg/cm^2$ in the direction along the longitudinal direction of the photosensitive web, and that of 6,000 to 9,000 $kg/cm^2$ in the width direction. The initial modulus also is measured according to the procedure described in JIS K 7127. Further, the heat-shrinkable strip of the invention preferably has a moisture permeability of 1.5 to 2.5 $g/m^2 \cdot 24$ h, which is measured according to the procedure described in JIS Z 0208.

The strip preferably has a water vapor transmission rate of less than 10 $g/m^2 \cdot 24$ hrs so as to keep the photosensitive web from deterioration caused by contact with water vapor present in the surrounding atmosphere.

The light-shielding flange disc for the continuous light-shielding photosensitive web is well know. Any of the known light-shielding flange disc can be employable for the light-shielding packaging of the invention. The flange disc preferably has a core portion which is inserted into the core on which the photosensitive web is wound. The light-shielding flange disc comprises a resin material and a colorant such as carbon black. The resin material may be polystyrene, polypropylene, polyethylene, polycarbonate, or polyacetal, ABS resin. The preferred content of carbon black varies depending upon the thickness of the flange disc. For instance, a flange disc of 1 mm thick generally contains 1 to 15 wt. %, preferably 2 to 10 wt. %, more preferably 3 to 7 wt. %, of carbon black. The thickness of the flange disc generally is in the range of 1 to 3.5 mm, preferably 1.5 to 3 mm.

On the light-shielding flanges, one or more labels can be placed for recording information relative to the photosensitive web. The information can be the sensitivity of the photosensitive web, lot No., size, production date, or the like. Such information can be printed directly on the flange. The label may be placed on other members such as core.

The light-shielding packaging of the invention is manufactured by causing heat shrinkage at the side portion of the leader sheet by applying a hot air or heating means to the side portion, after the leader sheet is wound to cover the circumference of the flange disc. The heating temperature is selected to approximately match with a temperature within 60 to 140° C. and at which the leader sheet shows a heat shrinkage ratio in the range of 5 to 30% in the longitudinal direction of the web at a temperature in the range of 60 to 140° C., particularly at approximately 100° C. The heat shrinkage ratio in the width direction at 100° C. is less than that in the longitudinal direction. The heat-shrinkage occurring in the side portions of the light-shielding leader sheet in the direction along the longitudinal direction of the continuous photosensitive web by the heat treatment causes the side portion of the leader sheet to attach tightly onto the periphery of the light-shielding flange, so that satisfactory light-shielding is attained. The attachment is well kept in the course of storing and transporting the packaged photosensitive web roll.

Figure 2:
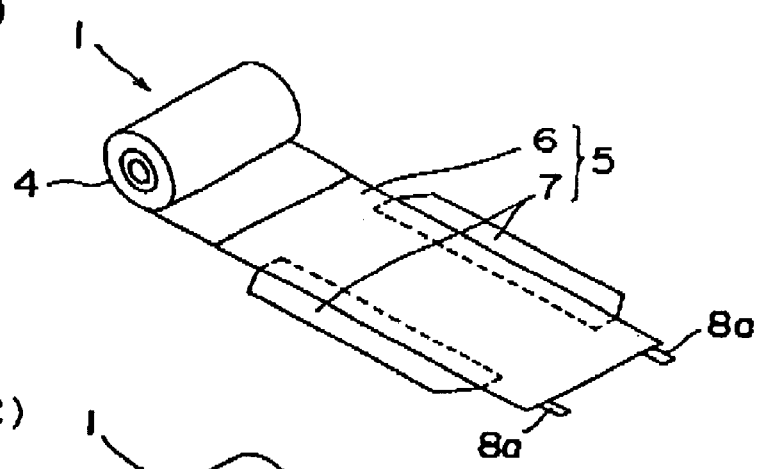
FIG. 2 illustrates steps of light-tightly packaging a continuous photosensitive web equipped with a light-shielding leader sheet.
Figure 2:
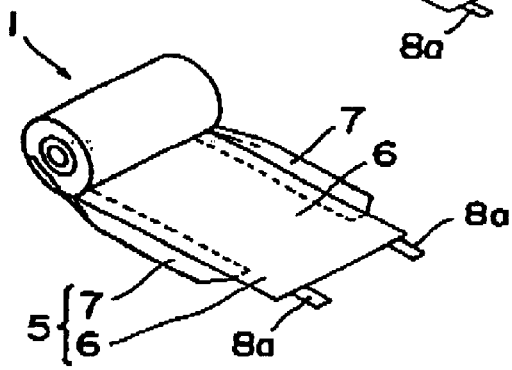
Figure 2:
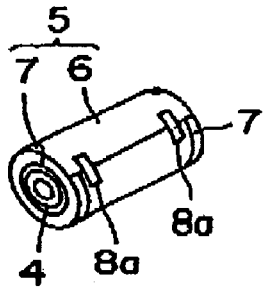
Figure 2:
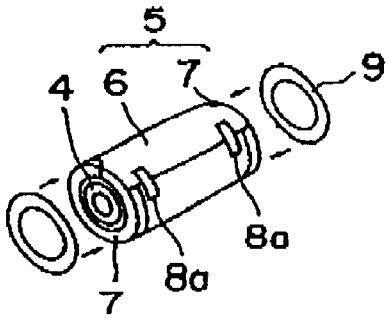

FIG. 2 illustrates the steps of packaging the rolled continuous photosensitive web 1 equipped with a longitudinal light-shielding sheet 5.

In the step 1, the partially rolled photosensitive web 1 is prepared, according to the conventional method.

In the step 2, the longitudinal light-shielding sheet 5 is wound over the roll 1 of the photosensitive web, folding inwardly the heat-shrinkable strip 7 on the outer surface of the flange 4.

In the step 3, the light-shielding leader sheet 5 is fully wound over the roll of the photosensitive web. The leading end of the light-shielding leader sheet 5 is fixed on the preceding convolution of the roll using a pair of adhesive tapes 8*a*.

In the step 4, the inwardly folded strip 7 temporarily attached to the flange 4 is pressed by a ring heater 9 so as to fix the strip onto the outer surface of the flange by partial fusion.

Alternatively, the step 2 can be carried out by applying a hot air to the strip on the flange surface so as to fuse the strip 7 onto the flange surface.

Figure 3:
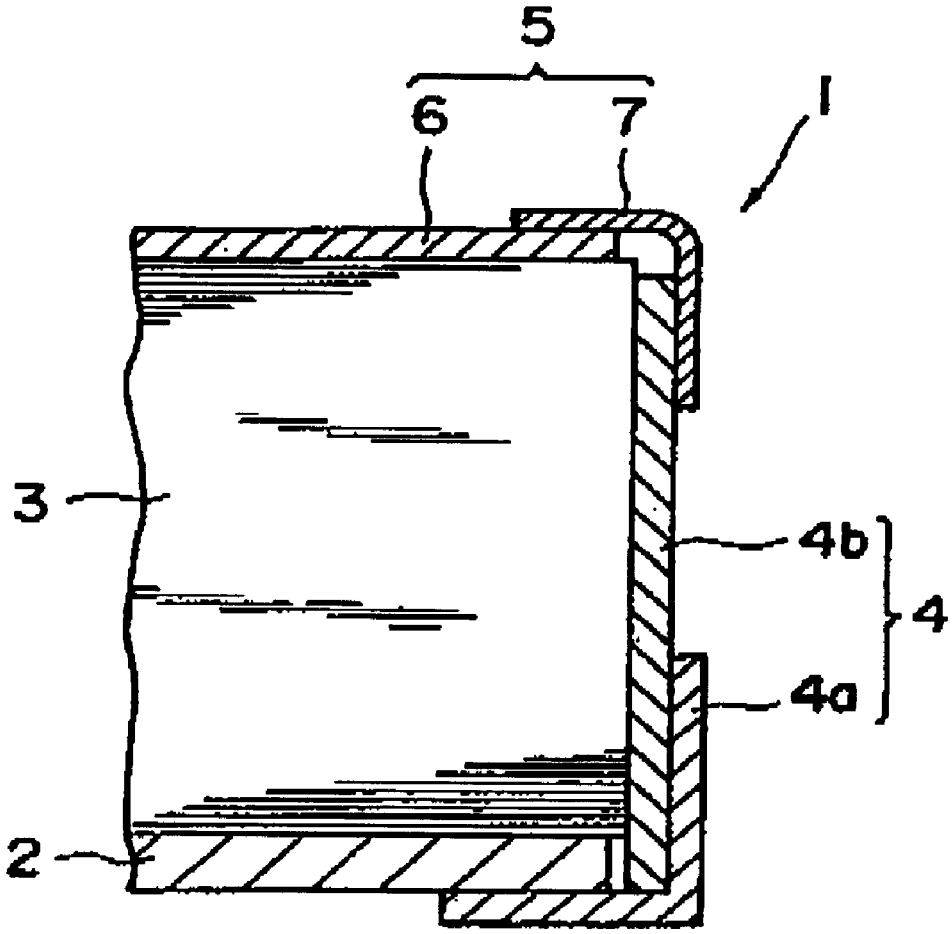
FIG. 3 is a section of one example of the sealing structure formed in the light-shielding packaging of the invention.

FIG. 3 is a section of one example of the roll 1 sealed between the flange disc 4 (composed of a cap 4*a* and a rig element 4*b*) and the light-shielding leader sheet 5 (composed of the base sheet 6 and the heat-shrunken strip 7, for keeping the photosensitive web from being exposed.

Figure 4:
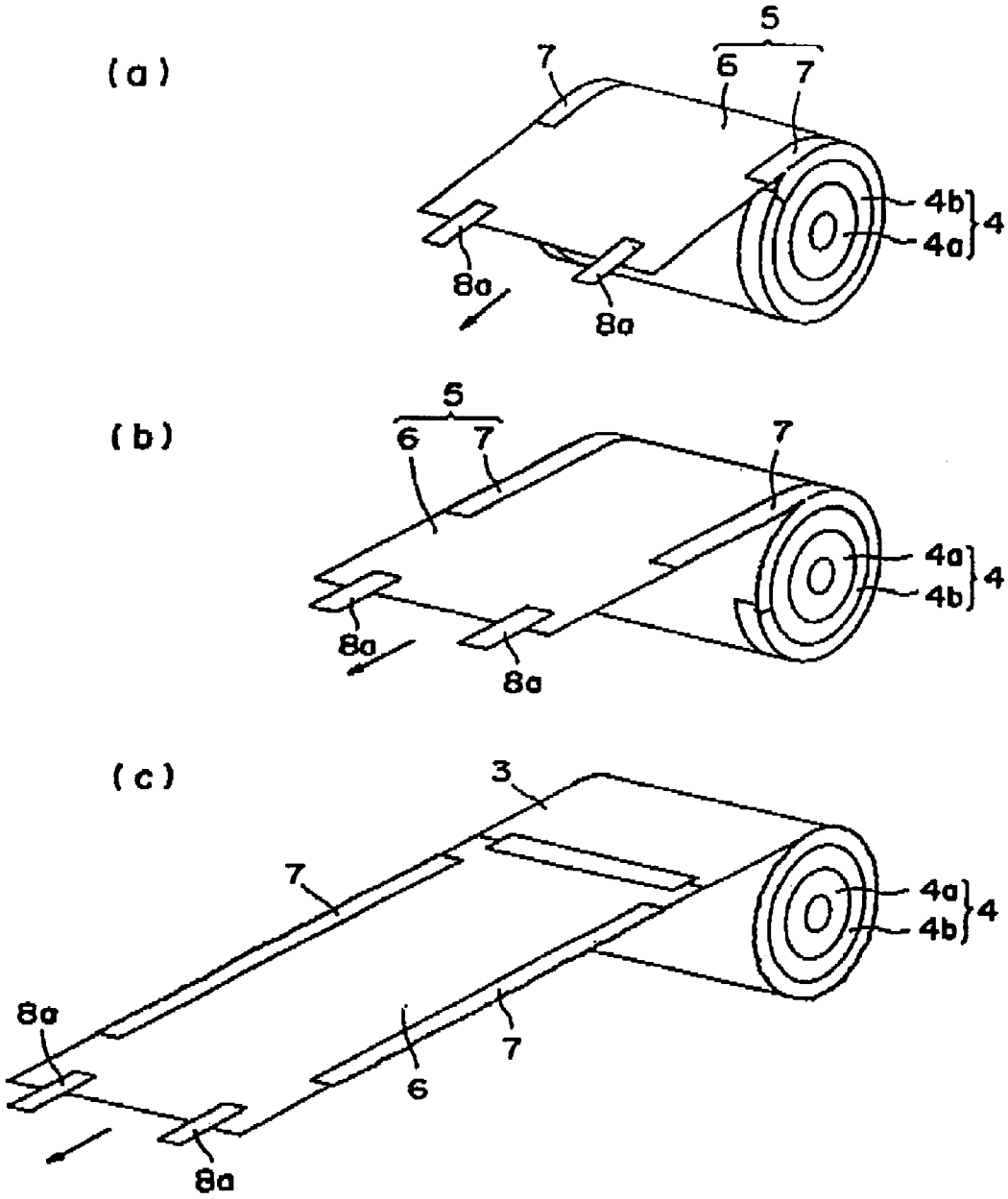
FIG. 4 illustrates steps of unwinding a packaged continuous photosensitive web using a light-shielding leader sheet attached to the end of the photosensitive web.

FIG. 4 illustrates steps of unwinding a packaged continuous photosensitive web using a light-shielding leader sheet attached to the end of the photosensitive web.

In the step (a), the adhesive tapes 8*a* and 8*b* are disengaged from the convolution and the leading end of the leader sheet 5 is drawn for unwinding the roll. In the course of the unwinding procedure, the strip 7 which is fixed onto the outer surface of the flange 4 is torn from the portion near to the leading end.

The strip 7 is further torn as the unwinding is advanced as is illustrated in the step (b). Furthermore, the strip 7 is fully torn and then the leader sheet 7 is fully separated from the flange 4.

EXAMPLE 1

(1) Preparation of Light-Shielding Leader Sheet

On each side of a heat-shrinkable film (TNS, available from Gunze Co., Ltd., thickness: 30 μm) was laminated a film of low density polyethylene resin (thickness: 30 μm, containing 5 wt. % of carbon black), to give a heat-shrinkable light-shielding strip having a heat shrinkage ratio (at 100° C) of 13.3% in its longitudinal direction and 11.9% in its width direction and an Elmendorf tearing strength (force) of 0.43N.

Onto each surface side of a light-shielding polyethylene terephthalate sheet (thickness: 100 μm, containing 5 wt. % of carbon black) was fixed the above-mentioned heat-shrinkable light-shielding strip in the manner as illustrated in FIG. 1, to produce a light-shielding leader sheet.

(2) Preparation of Packaged Photosensitive Web Roll

The light-shielding leader sheet produced in (1) above was combined to a photosensitive web roll using an adhesive tape. Further, a pair of light-shielding flanges were attached to the sides of the web roll.

Thus produced photosensitive web roll was wound in the manner as illustrated in FIG. 2, except that the inwardly folded strip was shrunken and fused to the flange by applying a hot air (heated to 270° C.) to the folded portion of the strip. Finally, a ring heater (heated to 130° C.) was pressed onto the shrunken and fused portion of the folded strip to fully fix the shrunken and fused portion of the folded strip, to manufacture a packaged photosensitive web roll.

(3) Evaluation

The packaged photosensitive web roll manufactured in (2) above was exposed to a light of 1,000 lux for one hour. Subsequently, the photosensitive web was taken out from the packaged roll by drawing the leader sheet by applying a force of 26 N. The strip whose outer portion was fused and fixed onto the flange was well torn along the side edge of the base sheet and on the cirmuferential edge of the flange.

The photosensitive web per se was not eased to the light and no decrease of photosensitivity was observed.

What is claimed is:

1. A continuous photosensitive web having at least at one end thereof a light-shielding leader sheet which comprises a longitudinal light-shielding base sheet and a pair of heat-shrinkable light-shielding strips having a heat shrinkage ratio at 100° C. in the range of 5% to 30% in the longitudinal direction and a heat shrinkage ratio at 100° C. of less than the heat shrinkage ratio in the longitudinal direction by 1% or more in a width direction thereof, in which each of the heat-shrinkable light-shielding strips is tearable predominantly in a longitudinal direction thereof and is fixed onto a surface of each side of the light-shielding base sheet under the condition that the light-shielding strip is aligned in paralled with the side of the longitudinal base sheet to project a portion thereof from the side of the base sheet.

2. The photosensitive web of claim 1, wherein the heat-shrinkable light-shielding strip has an Elmendorf tear strength in the range of 0.1N to 0.5N in the longitudinal direction.

3. The photosensitive web of claim 1, wherein the light-shielding base sheet has no heat-shrinkable property.

4. The photosensitive web of claim 1, wherein the heat-shrinkable light-shielding strip has a heat shrinkage ratio at 100° C. of less than the heat shrinkage ratio in the longitudinal direction by 5% or more in the width direction.

5. The photosensitive web of claim 1, wherein the heat-shrinkable light-shielding strip comprises a heat-shrinkable film placed between a pair of light-shielding thermoplastic films.

6. The photosensitive web of claim 5, wherein the light-shielding thermoplastic films are not heat-shrinkable.

7. A light-shielding packaging for a roll of continuous photosensitive web wound on a core having on each end thereof a light-shielding flange disc, which has at a leading end thereof a light-shielding leader sheet which comprises a longitudinal light-shielding base sheet and a pair of heat-shrinkable light-shielding strips having a heat shrinkage ratio at 100° C. in the range of 5% to 30% in the longitudinal direction and a heat shrinkage ratio at 100° C. of less than the heat shrinkage ratio in the longitudinal direction by 1% or more in a width direction thereof, in which each of the light-shielding strips is tearable predominantly in a longitudinal direction thereof and is fixed onto a surface of each side of the light-shielding base sheet under the condition that the light-shielding strip is aligned in parallel with the side of the longitudinal base sheet to project a portion thereof from the side of the base sheet, said leader sheet having a length larger than the length of the outermost convolution of the roll and a width larger than the distance between the outer face of one flange disc and the outer face of another flange disc, and each strip attached to the base sheet being light-tightly fixed via heat shrinkage and fusion thereof onto the outer face of the flange disc at least at a portion adjacent to the periphery of the flange disc.

8. The light-shielding packaging of claim 7, wherein the heat-shrinkable light-shielding strip has an Elmendorf tear strength in the range of 0.1N to 0.5N in the longitudinal direction.

9. The light-shielding packaging of claim 7, wherein the light-shielding base sheet has no heat-shrinkable property.

10. The light-shielding packaging of claim 7, wherein the heat-shrinkable light-shielding strip has a heat shrinkage ratio at 100° C. of less than the heat shrinkage ratio in the longitudinal direction by 5% or more in the width direction.

11. The light-shielding packaging of claim 7, wherein the heat-shrinkable light-shielding strip comprises a heat-shrinkable film placed between a pair of light-shielding thermoplastic films.

12. The light-shielding packaging of claim 11, wherein the light-shielding thermoplastic films are not heat-shrinkable.

13. The light-shielding packaging of claim 7, wherein each of the heat-shrinkable light-shielding strips is tearable along the side of the base sheet or along an outwardly extending curve starting from a point at which a leading end of the strip is in contact with the side of the base sheet.

* * * * *